United States Patent [19]

Bock

[11] Patent Number: 4,610,203

[45] Date of Patent: Sep. 9, 1986

[54] ELECTRICAL SEQUENTIAL FIRING SYSTEM

[75] Inventor: Immo E. Bock, Randburg, South Africa

[73] Assignee: Johannesburg Construction Corporation (Proprietary Limited), Johannesburg, South Africa

[21] Appl. No.: 657,289

[22] Filed: Oct. 3, 1984

[30] Foreign Application Priority Data

| | | | |
|---|---|---|---|
| Oct. 5, 1983 | [ZA] | South Africa | 83/7422 |
| Feb. 28, 1984 | [ZA] | South Africa | 84/1459 |
| Aug. 9, 1984 | [ZA] | South Africa | 84/6195 |

[51] Int. Cl.[4] ..... F42C 11/00

[52] U.S. Cl. ..... 102/217; 361/249

[58] Field of Search ..... 102/217, 206, 200; 361/248, 249

[56] References Cited

U.S. PATENT DOCUMENTS

| | | | |
|---|---|---|---|
| 3,424,924 | 1/1969 | Leisinger et al. | 102/217 |
| 3,468,255 | 9/1969 | Stryker, Jr. | 102/217 |
| 3,808,459 | 4/1974 | Guimier et al. | 102/217 |
| 3,953,804 | 4/1976 | Dethlefsen et al. | 315/323 |
| 4,099,467 | 7/1978 | Mackellar et al. | 102/217 |
| 4,314,507 | 2/1982 | Seligmann | 102/217 |
| 4,489,655 | 12/1984 | Molnar | 102/217 |

FOREIGN PATENT DOCUMENTS 0003412 1/1979 European Pat. Off. .

*Primary Examiner*—Charles T. Jordan

*Attorney, Agent, or Firm*—Biebel, French & Nauman

[57] ABSTRACT

This invention relates to sequential blasting utilizing electronic circuitry to steer detonating pulses to successive detonators. Modules are provided which contain a two-terminal element that has the characteristic that in its first normal state it has a high resistance in at least one direction and it may be changed into a second state in which it has a low resistance in both directions by a suitable pulse. Further, a detonating signal does not flow from one power line to the other through the particular module that is being addressed, but from one side of one module through a connecting link and then through the other module. Thus, each module has an input steering terminal and an output steering terminal, with the output steering terminal of each module connected to the input steering terminal of the next module. Then, in use, current flows from one power line to a power terminal of one module, through its output steering terminal to the input terminal of the next module, through that module and to the other power line. Thus, with each detonating pulse, a detonator is fused and one of the elements passes into its second conducting state. As the detonator goes into a non-conducting configuration the next pulse is steered via the element that is now conducting to the next module.

32 Claims, 13 Drawing Figures

ELECTRICAL SEQUENTIAL FIRING SYSTEM

This invention relates to an electrically operable sequential activation module and system and to a power source for operating such a sequential activation system. In particular the invention relates to a module and system for sequentially activating a device that has a low resistance prior to being activated and a high resistance thereafter. A device of this type is a detonator.

According to the invention there is provided an electrically operable sequential activation module for supplying an activation signal to a device which has a low resistance prior to being activated and a high resistance thereafter, the module being connectable in a series with other similar modules to sequentially activate a number of the devices, the module including

- a first convertible element which has two terminals and in its normal first state has a high resistance in at least one direction from its first terminal to its second terminal and which changes to a second state in which it has a low resistance in both directions when a first signal having a predetermined characteristic is applied across the element, the element thereafter retaining the low resistance in both directions when the first signal is removed;
- a basic power terminal by means of which the module is connectable to an electrical power source for supplying the first signal and an activating signal;
- a first and a second device terminal by means of which the device is connectable to the module;
- an input steering terminal, and;
- an output steering terminal which is connectable to the input steering terminal of a succeeding module in a series thereof;
- with the first device terminal connected to the input steering terminal;
- the second device terminal connected to the output steering terminal;
- the second device terminal also being connected to the second terminal of the first element; and
- the first terminal of the first element being connected to the basic power terminal.

The device may be activated by the same signal that changes the first element, so that the first signal and activating signal are one signal.

The first convertible element may, in its first state, have a high resistance in both directions.

Although it has been indicated that the device has a low resistance prior to being activated and a high resistance thereafter, it will be understood by those skilled in the art that the device may be composite in structure, comprising a unit which is activated and has a series unit that initially has the low resistance and thereafter the high resistance. Further, as the same effect will be obtained if the series unit is located in series with either the first or second device terminal the module itself may include the series unit in series with the first or second device terminals. It will accordingly be understood that the term "device which has a low resistance prior to being activated and a high resistance thereafter" is meant to include a composite device as described above, and a device which has a low resistance also after activation in combination with a unit that could be regarded as forming part of the module.

It will be appreciated that the first element may be of any suitable material, form or construction. However, the applicant believes that the most suitable material is a semiconductor material. Further, the element may have a single junction and may, for example, be a zener diode. The element may have two junctions, in which case it may be a bi-polar transistor with only the collector and emitter being used, these forming the terminals of the element. With a zener diode or bi-polar transistor, it has been found that if a voltage is applied across the diode or transistor that is just above the breakdown voltage of the diode or transistor, and the current through the diode or transistor maintained between certain predetermined levels for a sufficient period of time, then a conducting path is formed across the diode or transistor, which remains there after the voltage is removed. Further, this conducting path can then carry a greater current than that which formed the path without being destroyed.

Those skilled in the art will appreciate that in its basic form the module would have two power terminals, one of which would be connected to the first terminal of the first element and the other would be floating. For convenience, the basic power terminal that is connected to the first terminal of the first element is herein after referred to as the "second power terminal" and the other power terminal as the "first power terminal." If only one module were to be connected to the power supply then there would not be a path from one power terminal to the other via a device connected to the device terminals of the module. However, the modules are not used on their own but in a series, with the input steering terminal of each module in the series, except for a first module in the series, being connected to the output steering terminal of the preceding module and with their power terminals being interconnected. Further, the input steering terminal of the first module in the series is connected directly to its first power terminal or via a switch. Thus, in use, current will flow through the input steering terminal of the first module to its first device terminal, through the device to the second device terminal of the first module, and through the first element of the first module in the series. This will have the effect of changing this first element into its second state, so that the voltage across the device increases, thereby activating it. As there is now a conducting path between the second power terminal and the output steering terminal of the first module, there will then be a path through the next module if it is connected in an "inverted" manner, i.e. with its first power terminal connected to the second power terminal of the first module and its second power terminal connected to the first power terminal of the first module. Thus the modules are connected with opposite polarity and are successively operated by pulses of opposite polarity.

Accordingly the invention further provides an electrically operable sequential activation system, which includes a plurality of modules in accordance with the invention claims arranged in a series with the input steering terminal of each module other than the first module being connected to the output steering terminal of the preceeding module, and the first and second power terminals of the modules being interconnected.

As indicated above the modules may alternate, with the first and second power terminals of each module being connected to the second and first power terminals, respectively of an adjacent module.

In order to ensure that only one element is changed at a time, that only one device is activated at a time and that there is not a path which will have an decreasing resistance as the number of modules in the series increases, each module may include a signal blocking means which is connected between the second device terminal and the output steering terminal, and/or between the input steering terminal and the first device terminal, and/or between the second device terminal and the second terminal of the first element.

The signal blocking means may be a resistor, diode or any suitable component. It may also have the same characteristics as the first element, and may thus also be a bi-polar transistor, the collector and emitter thereof being used.

If the signal blocking means is a diode, it may have its anode connected to the second device terminal and its cathode connected to the output steering terminal. Alternatively, the anode may be connected to the input steering terminal and the cathode may be connected to the first device terminal. Further, if the signal blocking diode is connected between the second device terminal and the first element then its anode is connected to the second device terminal and its cathode is connected to the second terminal of the first element.

If the first element is an NPN bi-polar transistor, then its emitter may be connected to the second device terminal and its collector may be connected to the second power terminal. Alternatively, it may have its collector connected to the second device terminal and its emitter to the second power terminal.

The system may have different kinds of modules. Thus the system may have two groups of modules, with modules of one group alternating with those of the other group.

The module may include a second convertible element which has two terminals and in its normal first state has a high resistance in at least one direction from its first terminal to its second terminal and which changes to a second state in which it has a low resistance in both directions when a second signal having a predetermined characteristic is applied across the element, the element thereafter having the low resistance value in both directions when the second signal is removed, the first terminal of the second element being connected to the first power terminal and the second terminal of the second element being connected to the output steering terminal or the second device terminal, with the first element further being such that it changes into a third state when it is in its low resistance second state and a third signal having a predetermined characteristic is applied across the first element, in which third state it has a high resistance in both directions.

The second element may be substantially the same as the first element. Thus, the second element may also be a semiconductor, and may also have one or two junctions. Thus, it may also be a zener diode or a bi-polar transistor. If it is an NPN transistor then it may have its collector connected to the first power terminal and its emitter connected to the output steering terminal or the second device terminal.

Those skilled in the art will appreciate that when a transistor is converted into its conducting state as described above and a current of sufficient magnitude is passed therethrough for long enough, it will be damaged to such an extent that it forms an open circuit.

With modules having first and second elements it is possible to form a system without "inverting" any modules. Thus all the first power terminals are connected together and all the second power terminals are connected together. Then, the modules are supplied with a series of pulses, there being a positive pulse which changes the first element of the first module into its second state and activates the first device, a subsequent pulse of negative polarity which changes the second element of the first module into its second state and then increases in magnitude to change the first element of the first module into its third non-conducting state, with the sequence repeating. Each successive positive pulse causes the first element of the next module in the series to change into its second state and the device associated with that module to be activated. The invention accordingly extends further to a power source for an electrically operable sequential activation system, which supplies a repeating group of pulses, a first pulse in each group being of a predetermined polarity and a second pulse in each group being of the opposite polarity and which supplies second pulses that have an initial predetermined magnitude and thereafter have a greater magnitude.

The invention is now described, by way of examples with reference to the accompanying drawings, in which.

Figure 1:
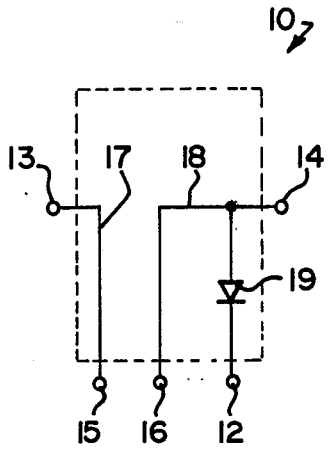
FIGS. 1 to 8 show different electrically operable sequential activation modules in accordance with the invention.

Referring to FIG. 1, shown therein designated generally by reference numeral 10 is an electrically operable sequential activation module for supplying an activation signal to a detonator (not shown in FIG. 1) which has a low resistance prior to being activated and a high resistance thereafter. As is discussed herein below, the module 10 is connected in a series with other similar modules to form an activation system.

Thus, as shown in FIG. 1, the module 10 has a second power terminal 12, an input steering terminal 13, an output steering terminal 14, a first device terminal 15 and a second device terminal 16. The input steering terminal 13 and the first device terminal 15 are directly electrically connected by means of a conducting link 17. Similarly, the second device terminal 16 and the output steering terminal 14 are directly connected by means of a link 18. The second device terminal 16 is also connected to the second power terminal 12 by means of a diode 19. The anode of the diode 19 is connected to the second device terminal 16 and the cathode is connected to the second power terminal 12. It will be noted, that as the second device terminal 16 and the output steering terminal 14 are directly connected, the diode 19 is also, in effect, connected between the output steering terminal 14 and the second power terminal 12. The diode 19 is such that in its normal first state it has a high resistance in the direction from the second power terminal 12 to the second device terminal 16 or output steering terminal 14; and a low resistance in the opposite direction. However, the diode 19 is such that when a current of a predetermined magnitude (in the order of 1 amp) is passed through the diode in its forward direction, for a suitable period of time, a conducting path is formed across the junction of the diode 19 such that it also has a low resistance from the second power terminal to the second device terminal 16.

Figure 2:
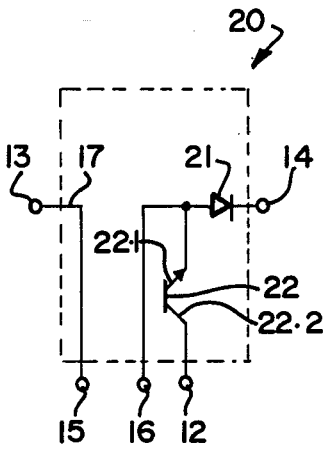

Referring to FIG. 2, a module 20 is shown therein which is similar to the module 10 of FIG. 1. Thus, the module 20 also has the various terminals designated in FIG. 1, which terminals are similarly referenced. The input steering terminal 13 and the first device terminal 15 are also directly connected by means of the link 17. However, there is a blocking diode 21 between the second device terminal 16 and the output steering terminal 14, with its anode being connected to the second device terminal 16 and its cathode to the output steering terminal 14. Instead of the diode 19 being connected between the second device terminal 16 and the second power terminal 12 as in the module 10, the module 20 has an NPN transistor 22 connected therebetween. The emitter 22.1 of the transistor 22 is connected to the second device terminal 16 and the collector 22.2 is connected to the second power terminal 12. The base of the transistor 22 is not utilised and is left floating. The transistor 22 is similar to the diode 19 of the module 10 in that it has a first normal state in which it has a high resistance in both directions and a second state in which it has a low resistance in both directions, and it changes from its first state to its second state when a current of about 1 A flows from its emitter to its collector.

Figure 3:
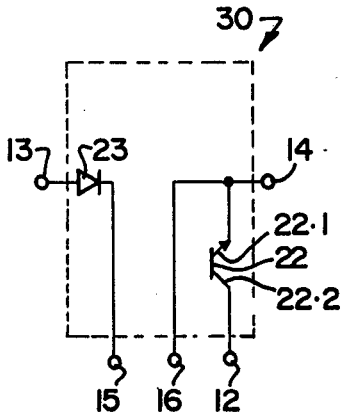

Referring now to FIG. 3, a further module 30 is shown therein. This module 30 has the same terminals as the previous two modules, which terminals are similarly referenced. The module 30 is similar to the module 20 shown in FIG. 2 in that it also utilises an NPN transistor 22 connected between the second device terminal 16 and the second power terminal 12. However, is has a blocking diode 23 connected between the input steering terminal 13 and the first device terminal 15 rather than between the second device terminal 16 and the output steering terminal 14. The anode of the blocking diode 23 is connected to the input steering terminal 13 and its cathode to the first device terminal 15.

Figure 4:
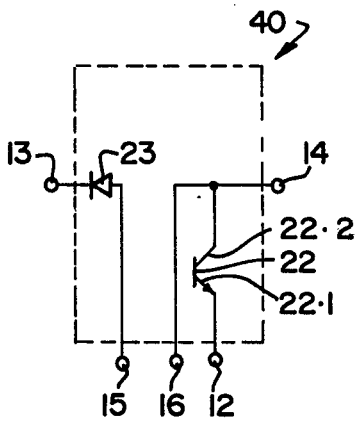

Referring now to FIG. 4 a further module 40 is shown therein. This module 40 is similar to the module 30 of FIG. 3 and is similarly referenced. However, the transistor 22 and the blocking diode 23 are reversed.

Figure 5:
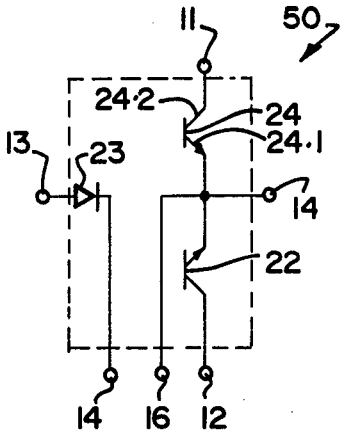

Referring now to FIG. 5, the module 50 shown therein is similar to the module 30 of FIG. 3 except that it has a further NPN transistor 24 connected between the first power terminal 11, on the one hand, and the second device terminal 16 and the output steering terminal 14 on the other. Thus, the collector 24.2 of the transistor 24 is connected to the first power terminal 11 and the emitter 24.1 is connected to the second device terminal 16 and the output steering terminal 14. The transistor 24 is similar to the transistor 22 in that it also changes from a first normal state in which it has a high resistance to a second state in which it conducts in both directions, when a current of about 1.5 A is passed therethrough from its emitter to its collector. Further, the transistor 22 is designed so that when in its second conducting state and the current of 1.5 A is passed through it, from its collector to its emitter, it changes to a third state in which it presents an open-circuit.

It will be appreciated that the diode 23 and transistors 22 and 24 may be reversed, such that the diode 23 has its cathode connected to the input steering terminal 13, and the transistors 22 and 24 have their collectors connected to the output steering terminal 14.

Figure 6:
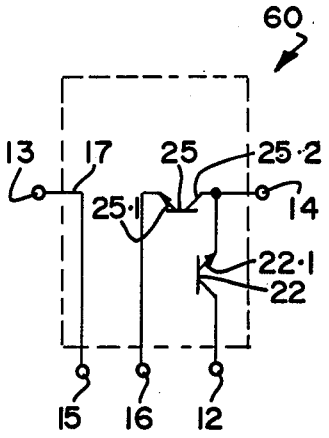

A still further module 60 shown in FIG. 6 which is similar to the previous modules and is similarly referenced. However, with this module 60 its transistor 22 is connected to the second device terminal 16 by means of a blocking transistor 25. Thus, the emitter 22.1 of the transistor 22 is connected to the output steering terminal 14, the collector 25.2 of the transistor 25 is also connected to the output steering terminal 14 and the emitter 25.1 of the transistor 25 is connected to the second device terminal 16. The transistor 25 also changes from its first normal state to its second conducting state together with its associated transistor 22.

Figure 7:
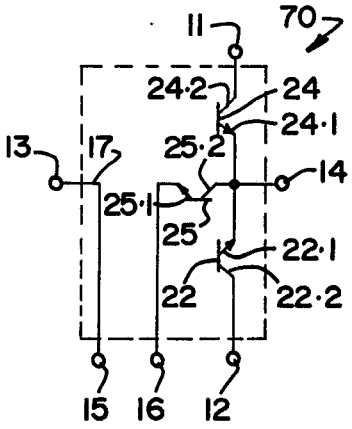

Referring now to FIG. 7, the module 70 shown therein is similar to the previous modules and is basically the module 60 together with the further transistor 24 of module 50. The transistor 24 is connected between the output steering terminal 14 and the first power terminal 11.

Figure 8:
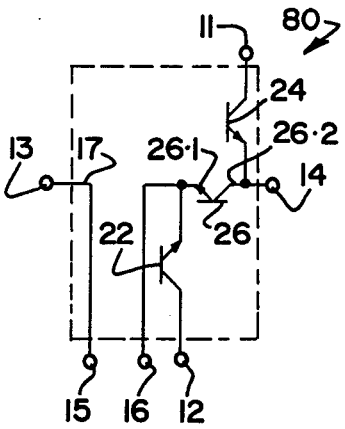

The module 80 shown in FIG. 8 also has the transistors 22 and 24 with the transistor 22 connected between the second device terminal 16 and the second power terminal 12 and with the transistor 24 connected between the first power terminal 11 and the output steering terminal 14. A blocking transistor 26 is connected between the second device terminal 16 and the output steering terminal 14. The transistor 26 is also an NPN transistor with its emitter 26.1 connected to the second device terminal 16 and its collector 26.2 connected to the output steering terminal 14. The transistor 26 is also convertible from a normal first state to a second conducting state.

Reference is now made to FIG.. 9. Shown therein, designated generally by reference numeral 110 is a system for sequentially activating a number of detonators 27. Thus, the system 110 is formed from a number of the modules 10 which are interconnected with one another and with a power supply 28. As shown, each module 10 has its device terminals 15,16 connected to its detonator 27. The input steering terminal 13 of each module other than the first module 10.1 is connected to the output steering terminal 14 of the preceding module; and the modules alternate such that the second power terminals 12 of the even numbered modules are connected to terminal 28.1 of the power supply 28 whereas the second power terminal 12 of the first module 10.1 and the other odd numbered modules are connected to the other terminal 28.2 of the power supply 28. Further, the terminal 28.1 of the power supply is connected to the input steering terminal 13 of the first module 10.1 via a switch 29.

In use, the power supply 28 supplies pulses of alternating polarity. Thus, when the switch 29 is closed and the first positive pulse is provided, this pulse flows through the first detonator 27.1 and the diode 19 of the first module 10.1. This first diode 19 is caused to go into its second state in which it conducts in both directions and the detonator 27.1 is activated. There is now a short circuit path between the second power terminal 12 of the second module 10.2 and its input steering terminal 13 via the conducting diode 19 of the first module 10.1. Thus, the next pulse which is a negative pulse, is routed to the second module 10.2, bearing in mind that the first detonator 27.1 has fused such that it presents an open circuit. This second negative pulse activates the detonator 27.2 of module 10.2 and also changes the diode 19 of the second module 10.2 into its second conducting state. The process is repeated, with the next pulse, which is the third pulse, being supplied to the third module 10.3. In this manner, pulses are successively steered to successive modules, the time period between successive activations being determined by the power supply 28.

Figure 9:
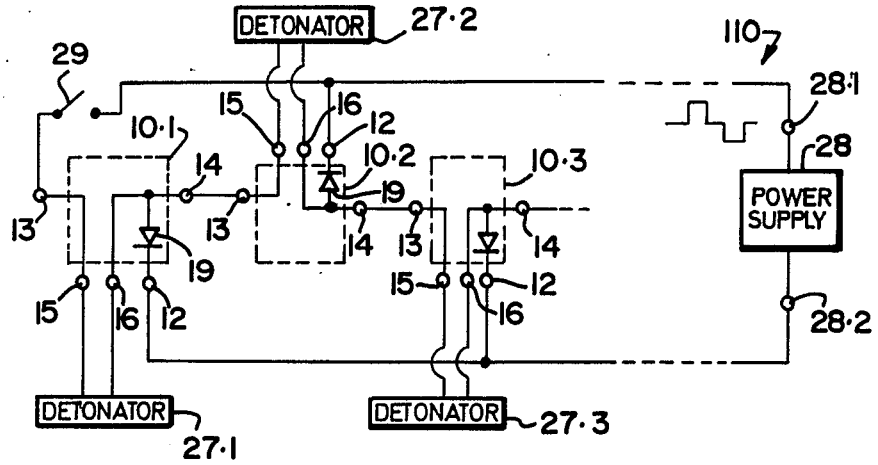
FIGS. 9 to 12 show sequential activation systems in accordance with the invention.
Figure 10:
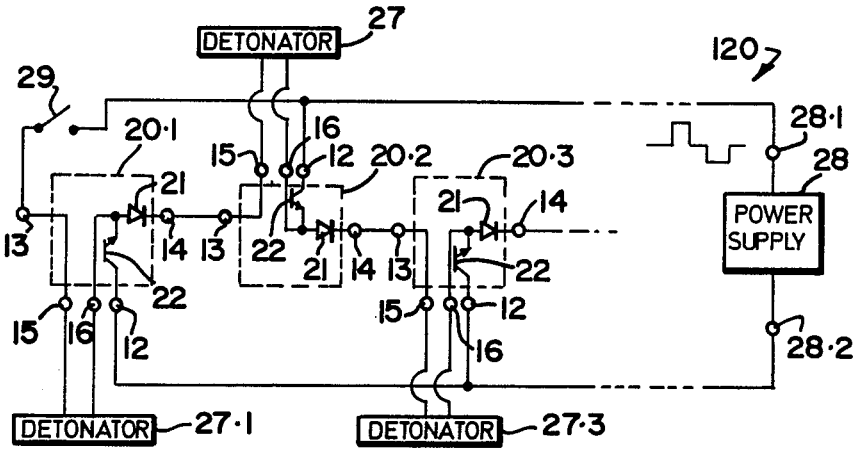

The system 120 shown in FIG. 10 is similar to that shown in FIG. 9 except that modules 20 are used instead of modules 10. As with the system 110, the transistors 22 are converted into their second state in which they conduct in both directions when the appropriate pulse supplied by the power supply 28 flows therethrough. It will be appreciated that the blocking diodes 21 minimise current drain through the path provided by the detonators connected to the second and third modules, the transistor 22 of the third module and the further paths in parallel with the transistor 22 of the third module. Otherwise, the operation of the system 120 is the same as that of the system 110.

Figure 11:
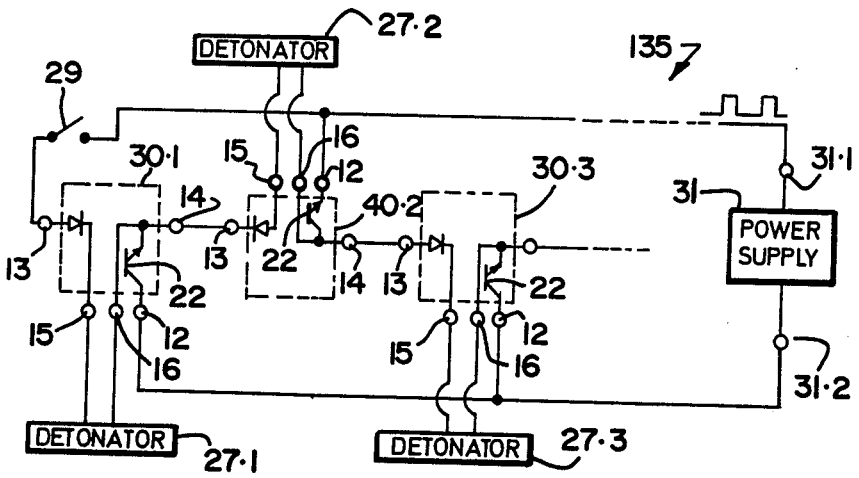

Referring now to FIG. 11 and the system 135 shown therein, this system 135 is comprised of modules 30 and modules 40. The modules 40 alternate with the modules 30 as shown. Thus, the odd numbered modules are modules 30 whereas the even numbered modules are modules 40. However, the modules 40 are "inverted" with regard to the modules 30, in that the second power terminals 12 of the modules 40 are connected to this terminal 31.1, whereas the second power terminals 12 of the modules 30 are connected to the other terminal 31.2 of the power supply 31. With this system 135, the power supply 31 supplies only positive pulses. As with the system 110 and 120, the first pulse is routed to the first module via the switch 29 and causes the transistor 22 to go into its second state. The next positive pulse is routed through the second module, which is a module 40 causing its detonator 27 to be activated and causing its transistor 22 to go into its second state. The third pulse is then routed via the second module to the third module, causing its detonator to be activated and causing its transistor 22 to go into its second state.

Figure 12:
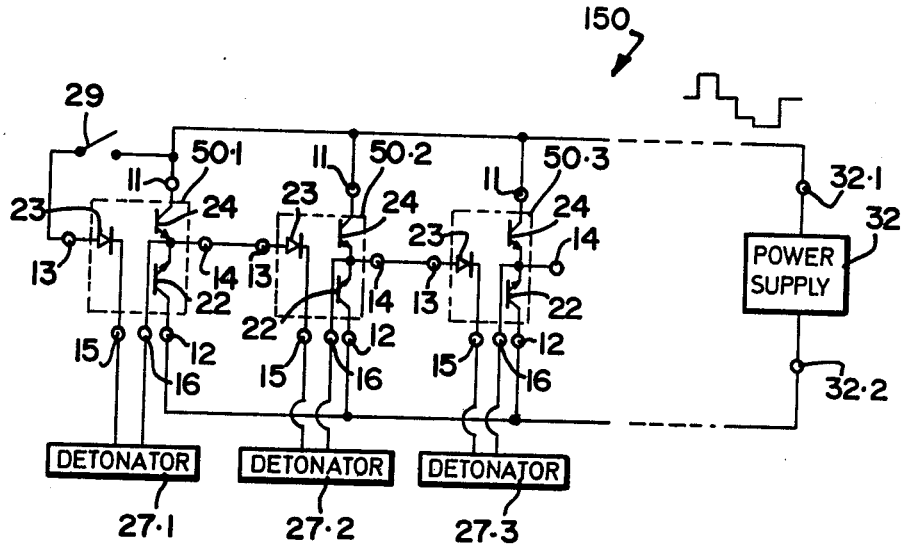

Referring now to FIG. 12, a further system 150 is shown. This system 150 is somewhat different from the other systems 110, 120 and 135, in that it utilises modules 50 that are all connected the same way and none are inverted. Thus, the first power terminals 11 of all the modules are connected to a terminal 32.1 of a power supply 32 and the second power terminals 12 of all the modules 50 are connected to the other terminal 32.2 of the power supply 32. With this system 150 the power supply supplies positive activating pulses and negative, two-stage arming pulses. Thus, when the first activating pulse is supplied it is routed to the first module 50.1 via the closed switch 29. This pulse activates the detonator 27 and causes the transistor 22 of the first module 50.1 to go into its second conducting state. The following arming pulse then passes through the transistor 22 and its associated transistor 24. The arming pulse initially has a suitable magnitude to cause the transistor 24 to go into its second conducting state and thereafter supplies a higher current which causes the transistor 22 to go into its third open circuit state. Thus, the following activating pulse that is supplied is routed to the second module 32.2 via the transistor 24 of the first module 50.1 which is in its conducting state. This second activating pulse then activates the second detonator 27 and causes the transistor 22 of the second module 50.2 to go into its second conducting state. The process is thus repeated with the detonators 27 being successively activated.

Figure 13:
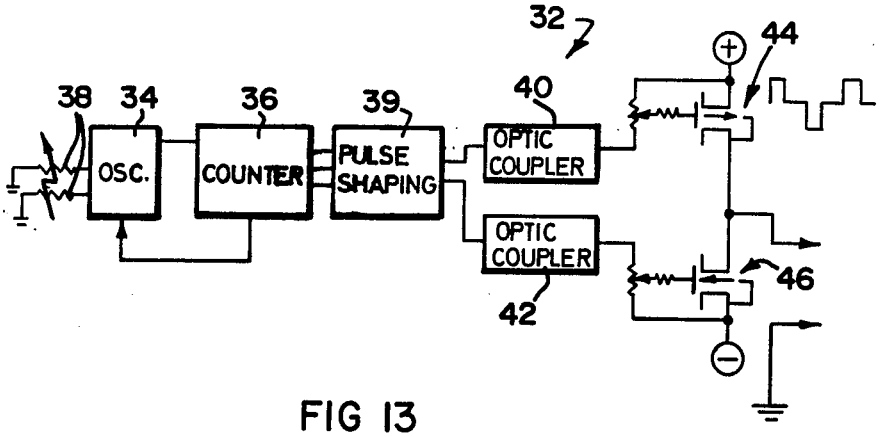
FIG. 13 shows a power source in accordance with the invention.

Referring now to FIG. 13, the power supply 32 is shown therein. The power supply 32 comprises a frequency shift key oscillator 34 which supplies a series of pulses to a two-bit counter 36. The oscillator 34 supplies two pulses, their duration and their inter-pulse duration being determined by two variable resistors 38. The counter 36 supplies pulses to a pulse shaping and boosting module 39 which splits the pulses and supplies one pulse to a first optic coupler 40 and the other pulse to a further optic coupler 42. These optic couplers 40 and 42 drive constant current sources 44 and 46 which utilise field effect transistors.

Although the specific examples described above utilise NPN transistors, those skilled in the art will appreciate that PNP transistors may be used solely or in combination with NPN transistors, suitable changes being made to the blocking components.

It will be understood by those skilled in the art that the invention provides a means whereby pyrotechnic elements may be activated in a controlled sequential manner utilising modules that are cheap to manufacture and are also robust.

I claim:

1. An electrically operable sequential activation module for supplying an activation signal to a device which has a low resistance prior to being activated and a high resistance thereafter, the module being connectable in a series with other similar modules to sequentially activate a number of the devices, the module including a first convertible element which has two terminals and in its normal first state has a high resistance in at least one direction from its first terminal to its second terminal and which changes to a second state in which it has a low resistance in both directions when a first signal having a predetermined characteristic is applied across the element, the element thereafter having the low resistance value in both directions when the first signal is removed;

a basic power terminal by means of which the module is connectable to an electrical power source for supplying the first signal and an activating signal;

a first and a second device terminal by means of which the device is connectable to the module;

an input steering terminal, and;

an output steering terminal which is connectable to the input steering terminal of a preceding module in a series thereof;

with the first device terminal connected to the input steering terminal;

the second device terminal connected to the output steering terminal;

the second device terminal also being connected to the second terminal of the first element; and the first terminal of the first element being connected to the basic power terminal.

2. The module as claimed in claim 1, which includes a signal blocking means which is connected between the second device terminal and the output steering terminal.

3. The module as claimed in claim 1, which includes a signal blocking means which is connected between the input steering terminal and the first device terminal.

4. The module as claimed in claim 1, in which the first element is of a semiconductor material.

5. The module as claimed in claim 4, in which the first element has a single junction.

6. The module as claimed in claim 4, in which the first element has two junctions.

7. The module as claimed in claim 6, in which the first element is a bi-polar transistor, its collector and emitter comprising its terminals.

8. The module as claimed in claim 7, in which the emitter of the transistor is connected to the second device terminal and the collector of the transistor is connected to the basic power terminal.

9. The module as claimed in claim 2, in which the signal blocking means is a diode, which has its anode connected to the second device terminal and its cathode connected to the output steering terminal.

10. The module as claimed in claim 3, in which the signal blocking means is a diode, which has its anode connected to the input steering terminal and its cathode connected to the first device terminal.

11. The module as claimed in claim 1, in which the first element is a bi-polar transistor that has its emitter cnnected to the basic power terminal and its collector connected to the second device terminal.

12. The module as claimed in claim 1, which includes a further power terminal and a second convertible element which has two terminals and in its normal first state has a high resistance in at least one direction from its first terminal to its second terminal and which changes to a second state in which it has a low resistance in both directions when a second signal having a predetermined characteristic is applied across the element, the element thereafter having the low resistance value in both directions when the second signal is removed, the first terminal of the second element being connected to the further power terminal and the second terminal of the second element being connected to the output steering terminal, with the first element further being such that it changes into a third state when it is in its low resistance second state and a third signal having a predetermined characteristic is applied across the first element, in which third state it has a high resistance in both directions.

13. The module as claimed in claim 1, which includes a second convertible element which has two terminals and in its normal first state has a high resistance in at least one direction from its first terminal to its second terminal and which changes to a second state in which it has a low resistance in both directions when a second signal having a predetermined characteristic is applied across the element, the element thereafter having the low resistance value in both directions when the second signal is removed, the first terminal of the second element being connected to the further power terminal and the second terminal of the second element being connected to the second device terminal, with the first element further being such that it changes into a third state when it is in its low resistance second state and a third signal having a predetermined characteristic is applied across the first element, in which third state it has a high resistance in both directions.

14. The module as claimed in claim 12, in which the first element is a bi-polar transistor, the emitter and collector of which comprise its terminals.

15. The module as claimed in claim 14, in which the emitter of the first element is connected to the second device terminal and the collector thereof is connected to the basic power terminal.

16. The module as claimed in claim 14, in which the second element is also a bi-polar transistor, the collector of which is connected to the first power terminal and the emitter of which is connected to the second device terminal or the output steering terminal.

17. The module as claimed in claim 12, which includes a signal blocking means which is connected between the second device terminal and the output steering terminal.

18. The module as claimed in claim 12, which includes a signal blocking means which is connected between the input steering terminal and the first device terminal.

19. The module as claimed in claim 1, in which the first element is connected to the second device terminal via a signal blocking means.

20. An electrically operable sequential activation system, which includes a plurality of modules as claimed in claim 1 arranged in a series with the input steering terminal of each module other than the first module being connected to the output steering terminal of the preceding module, and the basic and further power terminals of the modules being interconnected.

21. An electrically operable sequential activation system, which includes a plurality of modules as claimed in claim 1, arranged in a series with the input steering terminal of each module other than the first module being connected to the output steering terminal of the preceding module, and the modules alternating with the basic and further power terminals of each module being connected to the further and basic power terminals, respectively of an adjacent module.

22. An electrically operable sequential activation system which includes a number of modules as claimed in claim 1, with some modules forming a first group and the other modules forming a second group, the first elements of the modules of the second group each being a bi-polar transistor that has its emitter connected to its associated basic power terminal and collector connected to its associated second device terminal, with the input steering terminal of each module other than the first module being connected to the output steering terminal of the preceding module, and the modules of the first group alternating with the modules of the second group, with the further and basic power terminals of each module of the first group being connected to the basic and further power terminals, respectively, of an adjacent module of the second group.

23. An electrically operable sequential activation system, which includes a plurality of modules as claimed in claim 12 arranged in a series with the input steering terminal of each module other than the first module being connected to the output steering terminal of the preceding module, and the further and basic power terminals of each module being connected to the further and basic power terminals, respectively of an adjacent module.

24. An electrically operable sequential activation system, which includes a plurality of modules as claimed in claim 13, arranged in a series with the input steering terminal of each module other than the first module being connected to the output steering terminal of the preceding module, and the further and basic power terminals of each module being connected to the further and basic power terminals, respectively of an adjacent module.

25. An electrically operable sequential activation system, which includes a number of modules as claimed in claim 1 arranged in a series, with some of the modules forming a first group and the others forming a second group, the modules of the first group each including a further power terminal;

a second convertible element which has two terminals and in its normal first state has a high resistance in at least one direction from its first terminal to its second terminal and which changes to a second state in which it has a low resistance in both directions when a second signal having a predetermined characteristic is applied across the element, the element thereafter having a low resistance value in both directions when the second signal is removed, the first terminal of the second element being connected to the further power terminal and the second terminal of the second element being connected to the output steering terminal, with the first element further being such that it changes into a third state when it is in its low resistance second state and a third signal having a predetermined characteristic is applied across the first element, in which third stage it has a high resistance in both directions;

and a signal blocking means which is connected between the input steering terminal and the first device terminal, with the input steering terminals of each module other than the first module being connected to the output steering terminal of the preceding module, and the modules of the first group alternating with the modules of the second group, with the further and basic power terminals of each module of the first group being connected to the basic and further power terminals, respectively, of an adjacent module of the second group.

26. The system as claimed in claim 21, which includes a plurality of devices, there being a device connected to the first and second device terminals of each module.

27. The system as claimed in claim 21, which includes an electrical power source connected to the further and basic power terminals of a last module in the series, the power source being such that it supplies a series of first signals and activating signals that are pulses of alternating polarity.

28. The system as claimed in claim 22, which includes an electrical power source connected to the further and basic power terminals of a last module in the series, the power source being such that it supplies a series of first signals and activating signals that are pulses of the same polarity.

29. The system as claimed in claim 22, which includes an electrical power source connected to the further and basic power terminals of a last module in the series, the power source being such that it supplies a series of first signals and activating signals that are of a constant DC value.

30. The system as claimed in claim 24, which includes an electrical power source connected to the further and basic power terminals of a last module in the series, the power source being such that it repeatedly supplies a first signal, an activating signal, a second signal, and a third signal, the first and activating signals being pulses of a predetermined polarity and the second and third signals being pulses of the opposite polarity.

31. The system as claimed in claim 30, in which the power source supplies second signals that have a magnitude that is less than the magnitude of the third signals.

32. The system as claimed in claim 26, in which the devices are detonators.

* * * * *